US008562087B2

(12) United States Patent
Eom et al.

(10) Patent No.: US 8,562,087 B2
(45) Date of Patent: Oct. 22, 2013

(54) REFRIGERATOR AND METHOD FOR CONTROLLING SAME

(75) Inventors: Yong Hwan Eom, Seoul (KR); Myung Keun Yoo, Seoul (KR); Hyoun Jeong Shin, Seoul (KR); Ok Sun Yu, Seoul (KR); Young Jin Kim, Seoul (KR); Seung Do Han, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 12/724,558

(22) Filed: Mar. 16, 2010

(65) Prior Publication Data

US 2010/0236277 A1 Sep. 23, 2010

(30) Foreign Application Priority Data

Mar. 20, 2009 (KR) ..... 10-2009-0024203

(51) Int. Cl.
*A47B 96/04* (2006.01)

(52) U.S. Cl.
USPC ..... 312/402; 312/319.5; 312/331

(58) Field of Classification Search
USPC ..... 312/402, 404, 405, 319.5, 330.1, 331, 312/334.1, 334.8; 62/440, 449
See application file for complete search history.

(56) References Cited

U.S. PATENT DOCUMENTS

| | | | |
|---|---|---|---|
| 2,873,159 | A | 2/1959 | Otto |
| 4,829,429 | A | 5/1989 | Komai et al. |
| 5,280,227 | A | 1/1994 | Bashark |
| 5,392,951 | A | 2/1995 | Gardner et al. |
| 5,445,294 | A | 8/1995 | Gardner et al. |
| 5,775,786 | A | 7/1998 | Liebertz |
| 5,899,083 | A | 5/1999 | Peterson et al. |
| 5,940,306 | A | 8/1999 | Gardner et al. |
| 6,130,621 | A | 10/2000 | Weiss |
| 6,445,152 | B1 | 9/2002 | Calamatas |
| 6,751,909 | B2 | 6/2004 | Ranaudo |
| 6,779,855 | B2 | 8/2004 | Hoffman |
| 7,006,876 | B2 | 2/2006 | Ross |
| 7,063,398 | B2 | 6/2006 | Hoffman |
| 7,075,446 | B2 | 7/2006 | Schondelmaier et al. |
| 7,121,099 | B2 | 10/2006 | Shimizu et al. |
| 7,197,888 | B2 | 4/2007 | LeClear et al. |
| 7,282,884 | B2 | 10/2007 | Huber et al. |
| 7,307,395 | B2 | 12/2007 | Bouamra et al. |
| 7,407,210 | B2 | 8/2008 | Arbaugh et al. |
| 7,430,937 | B2 | 10/2008 | Rotter et al. |

(Continued)

FOREIGN PATENT DOCUMENTS

| | | | |
|---|---|---|---|
| CN | 2406551 | A | 11/2000 |
| CN | 1468569 | A | 1/2004 |

(Continued)

OTHER PUBLICATIONS

Chinese Office Action issued in CN Application No. 2011092100646340 dated Sep. 26, 2011.

(Continued)

*Primary Examiner* — Hanh V Tran
(74) *Attorney, Agent, or Firm* — KED & Associates LLP

(57) ABSTRACT

A refrigerator and a method for controlling such a refrigerator is provided in which a receiving box may be automatically drawn in and out together with a door that forms a front face thereof in response to a command input at an input unit, thereby increasing user convenience.

6 Claims, 7 Drawing Sheets

(56) References Cited

U.S. PATENT DOCUMENTS

| | | | | |
|---|---|---|---|---|
| 7,484,817 | B2 | 2/2009 | Hoffman et al. | |
| 7,533,947 | B2 | 5/2009 | Kim et al. | |
| 7,587,907 | B2 | 9/2009 | Kim et al. | |
| 7,594,707 | B2 | 9/2009 | Kunkle et al. | |
| 7,602,135 | B2 | 10/2009 | Huber et al. | |
| 7,633,258 | B2 * | 12/2009 | Huber et al. | 318/646 |
| 7,641,707 | B2 | 1/2010 | Kang et al. | |
| 7,688,015 | B2 | 3/2010 | Wenzel et al. | |
| 7,731,314 | B2 | 6/2010 | Kim | |
| 7,784,888 | B2 | 8/2010 | Oh et al. | |
| 7,800,477 | B1 | 9/2010 | Komer | |
| 7,802,515 | B2 | 9/2010 | Suetsugu | |
| 7,812,561 | B2 | 10/2010 | Hagen et al. | |
| 7,859,203 | B2 | 12/2010 | Miyashita | |
| 7,868,578 | B2 | 1/2011 | Scheffknecht et al. | |
| 7,928,684 | B2 | 4/2011 | Hauer | |
| 8,067,915 | B2 | 11/2011 | Hooker et al. | |
| 8,074,468 | B2 | 12/2011 | Yoo et al. | |
| 8,134,313 | B2 | 3/2012 | Zipp | |
| 8,141,968 | B2 | 3/2012 | Velarde et al. | |
| 8,169,175 | B2 | 5/2012 | Yu et al. | |
| 8,169,176 | B2 | 5/2012 | Yu et al. | |
| 8,217,613 | B2 | 7/2012 | Yoo et al. | |
| 8,274,251 | B2 | 9/2012 | Yoo et al. | |
| 8,282,177 | B1 | 10/2012 | Rotter | |
| 2001/0009360 | A1 | 7/2001 | Jin | |
| 2002/0171335 | A1 | 11/2002 | Held | |
| 2003/0078710 | A1 | 4/2003 | Li | |
| 2004/0035129 | A1 | 2/2004 | Kaiser | |
| 2004/0100165 | A1 | 5/2004 | Hoffman | |
| 2004/0100166 | A1 | 5/2004 | Hoffman | |
| 2004/0100169 | A1 | 5/2004 | Huber et al. | |
| 2004/0138843 | A1 | 7/2004 | Bouamra et al. | |
| 2005/0128660 | A1 | 6/2005 | Dlugosz | |
| 2005/0284113 | A1 | 12/2005 | Jang et al. | |
| 2006/0042301 | A1 * | 3/2006 | Oh et al. | 62/407 |
| 2006/0061245 | A1 | 3/2006 | Huber et al. | |
| 2006/0087207 | A1 | 4/2006 | Oh et al. | |
| 2006/0087208 | A1 | 4/2006 | Oh et al. | |
| 2006/0096304 | A1 | 5/2006 | Kim et al. | |
| 2006/0104756 | A1 | 5/2006 | Kim et al. | |
| 2006/0196198 | A1 | 9/2006 | Kim et al. | |
| 2006/0207283 | A1 | 9/2006 | Kim et al. | |
| 2006/0226749 | A1 | 10/2006 | Kim | |
| 2006/0242988 | A1 | 11/2006 | Kim et al. | |
| 2006/0261775 | A1 | 11/2006 | Huber et al. | |
| 2006/0267461 | A1 | 11/2006 | Hoffman | |
| 2007/0013274 | A1 | 1/2007 | Hoffman | |
| 2007/0170828 | A1 | 7/2007 | Hoshide et al. | |
| 2007/0256036 | A1 | 11/2007 | Johnson et al. | |
| 2008/0018215 | A1 | 1/2008 | Carden et al. | |
| 2008/0110092 | A1 | 5/2008 | Takahashi | |
| 2008/0116777 | A1 | 5/2008 | Kappler et al. | |
| 2008/0163639 | A1 | 7/2008 | Hwang | |
| 2008/0302114 | A1 | 12/2008 | Kelly et al. | |
| 2008/0314067 | A1 | 12/2008 | Lee | |
| 2009/0026906 | A1 | 1/2009 | Kim | |
| 2009/0091223 | A1 | 4/2009 | Hagen et al. | |
| 2009/0102338 | A1 | 4/2009 | Wenzel et al. | |
| 2009/0160297 | A1 | 6/2009 | Anikhindi et al. | |
| 2009/0199484 | A1 | 8/2009 | Zipp | |
| 2009/0206715 | A1 | 8/2009 | Scheffknecht et al. | |
| 2009/0243454 | A1 | 10/2009 | Yoo et al. | |
| 2009/0248205 | A1 | 10/2009 | Yu et al. | |
| 2009/0248207 | A1 | 10/2009 | Yoo et al. | |
| 2009/0254221 | A1 | 10/2009 | Kang | |
| 2009/0261698 | A1 | 10/2009 | Cabal Velarde et al. | |

FOREIGN PATENT DOCUMENTS

| | | | |
|---|---|---|---|
| CN | 101358792 | A | 2/2009 |
| EP | 0779484 | | 6/1997 |
| JP | 1990-103388 | | 4/1990 |
| JP | 1990-106686 | | 4/1990 |
| JP | 1990-136686 | | 5/1990 |
| JP | 1990-146487 | | 6/1990 |
| JP | 1991-045820 | | 2/1991 |
| JP | 07-174459 | | 7/1995 |
| JP | 1995-174459 | | 7/1995 |
| JP | 1999-094455 | | 4/1999 |
| JP | 2005-326044 | | 11/2005 |
| JP | 2006-023039 | | 1/2006 |
| JP | 2006-046741 | | 2/2006 |
| JP | 2006-046748 | | 2/2006 |
| JP | 2006-145055 | | 6/2006 |
| JP | 2006-250485 | | 9/2006 |
| JP | 2007-017018 | | 1/2007 |
| JP | 2007-093208 | | 4/2007 |
| JP | 2007-132605 | | 5/2007 |
| JP | 2008-8550 | | 1/2008 |
| JP | 2008-196752 | | 8/2008 |
| JP | 2008496744 | | 8/2008 |
| JP | 2009-036433 | | 2/2009 |
| KR | 1999-003684 | | 1/1999 |
| KR | 20-0301747 | | 1/2003 |
| KR | 20-0334077 | | 11/2003 |
| KR | 10-2006-0025806 | | 3/2006 |
| KR | 2006-0025806 | | 3/2006 |
| KR | 1020060025806 | * | 3/2006 |
| KR | 10-0634366 | | 10/2006 |
| KR | 2007-008046 | | 1/2008 |
| WO | WO 2006/126584 | | 11/2006 |
| WO | WO2007/009783 | | 1/2007 |

OTHER PUBLICATIONS

U.S. Office Action issued in U.S. Appl. No. 12/510,372 dated Nov. 30, 2011.

International Search Report issued in PCT Application No. PCT/KR2010/001496 dated Oct. 22, 2010.

International Search Report issued in PCT Application No. PCT/KR2010/001495 dated Oct. 25, 2010.

International Search Report issued in PCT Application No. PCT/KR2010/001409 dated Oct. 25, 2010.

International Search Report issued in PCT Application No. PCT/KR2010/001410 dated Oct. 25, 2010.

U.S. Office Action issued in U.S. Appl. No. 12/390,520 dated Apr. 22, 2011.

U.S. Office Action issued in U.S. Appl. No. 12/345,946 dated May 19, 2011.

U.S. Office Action issued in U.S. Appl. No. 12/345,984 dated May 23, 2011.

International Search Report dated Dec. 3, 2008. (Application No. PCT/KR2008/001694).

International Search Report dated Dec. 3, 2008. (Application No. PCT/KR2008/001696).

International Search Report dated Dec. 3, 2008. (Application No. PCT/KR2008/001697).

International Search Report dated Dec. 8, 2008. (Application No. PCT/KR2008/001695).

International Search Report dated Oct. 22, 2010 (Application No. PCT/KR2010/001497).

U.S. Office Action issued in U.S. Appl. No. 12/390,524 dated Aug. 25, 2011.

U.S. Office Action issued in U.S. Appl. No. 12/345,946 dated Sep. 26, 2011.

U.S. Office Action issued in U.S. Appl. No. 12/345,984 dated Sep. 26, 2011.

U.S. Office Action issued in U.S. Appl. No. 12/390,523 dated Feb. 7, 2012.

U.S. Office Action issued in U.S. Appl. No. 12/390,527 dated Feb. 14, 2012.

Notice of Allowance issued in U.S. Appl. No. 12/390,523 dated Jun. 27, 2012.

Office Action issued in U.S. Appl. No. 12/724,606 dated Sep. 13, 2012.

Chinese Office Action issued in CN Application No. 201080012399.5 dated Oct. 24, 2012.

(56) References Cited

OTHER PUBLICATIONS

U.S. Notice of Allowance issued in U.S. Appl. No. 12/724,648 dated Nov. 9, 2012.
U.S. Office Action issued in U.S. Appl. No. 12/724,571 dated Nov. 16, 2012.
U.S. Office Action issued in U.S. Appl. No. 12/726,643 dated Dec. 5, 2012.
U.S. Office Action issued in U.S. Appl. No. 12/724,606 dated Jan. 11, 2013.
Chinese Office Action issued in CN Application No. 201080012987.9 dated Dec. 12, 2012.
Notice of Allowance issued in U.S. Appl. No. 12/724,571 dated Mar. 7, 2013.

* cited by examiner

REFRIGERATOR AND METHOD FOR CONTROLLING SAME

CROSS REFERENCES RELATED APPLICATIONS

This claims priority under 35 U.S.C. 119 and 35 U.S.C. 365 to Korean Patent Application No. 10-2009-0024203 (filed in Korea on Mar. 20, 2009), the entirety of which is incorporated herein by reference.

BACKGROUND

1. Field

This relates to a refrigerator and a method for controlling the same.

2. Background

Generally, a refrigerator stores items in a refrigerated or frozen state. Refrigerators may be classified as a top mount type refrigerator, a bottom freezer type refrigerator or a side by side type refrigerator, depending on the relative locations of a freezing chamber and a refrigerating chamber.

BRIEF DESCRIPTION OF THE DRAWINGS

Embodiments will be described in detail with reference to the following drawings in which like reference numerals refer to like elements wherein.

DETAILED DESCRIPTION

Figure 1:
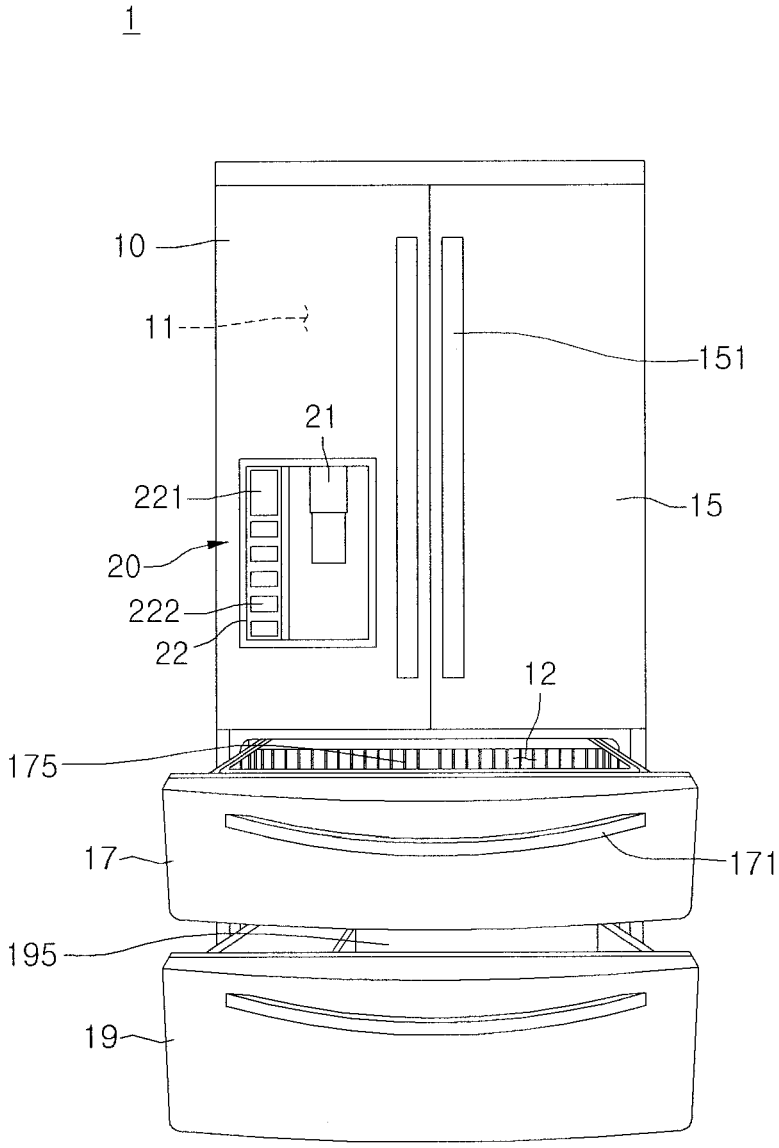
FIG. 1 is a front view of an exemplary refrigerator according to an embodiment as broadly described herein.

In the following detailed description, reference is made to the accompanying drawings that form a part hereof, and in which is shown by way of illustration of various embodiments. These embodiments are described in sufficient detail to enable those skilled in the art, and it is understood that other embodiments may be utilized and that logical structural, mechanical, electrical, and chemical changes may be made without departing from the spirit or scope as embodied and broadly described herein. The following detailed description is not to be taken in a limiting sense.

In a bottom freezer type refrigerator, a freezing chamber is positioned below a refrigerating chamber, a refrigerating chamber door is rotatably mounted at an edge of one side of a refrigerator main body to open and close the refrigerating chamber, and a freezing chamber door to open and close the freezing chamber may be provided in such a way that it is drawn into and out of the freezing chamber together with a receiving box in a drawer like fashion. Because the freezing chamber is below the refrigerating chamber, when the user opens the freezing chamber, the user must bend at the waist to pull the door of the freezing chamber forward, requiring more effort than when pulling the freezing chamber door in a standing position.

In a bottom freezer type refrigerator without a structure for automatically drawing out the receiving box, a user may pull on a handle provided the front surface of the receiving box to gain access to the receiving box positioned within the freezing chamber. However, a sealing member such as a gasket may be provided at a rear surface of the door to prevent cool air leakage, and the inside of the sealing member may include a close adhesion member such as a magnet, so that when the door is closed and the receiving box is positioned within the freezing chamber, it is closely adhered to the main body of the refrigerator by magnetic force. This requires that the user apply a force greater than the magnetic force when pulling on the handle in order to break the seal therebetween and draw out the receiving box. This may be more difficult when the freezing chamber is provided at the lower portion of the refrigerator, as the user must bend at the waist while also pulling.

Further, such a handle typically protrudes from the front surface of the receiving box, increasing a volume of packing materials in the refrigerator. When the refrigerator is installed in a room, a space corresponding to the protruded portion of the handle is occupied by the handle, thus degrading space utilization in the room. Further, a handle that protrudes from the front surface of the refrigerator may pose a risk of injury to occupants of the room.

A partially automatic opening structure that moves the freezing chamber door by a predetermined distance from a front surface of the main body has been developed to address this problem. This partially automatic opening structure senses the user's motion of holding and/or initial pull on a door handle to open the freezing chamber door.

Upon sensing this contact with/force exerted on the handle, a receiving box separating device pushes the receiving box by a predetermined distance to separate it from the main body of the refrigerator. However, in this type of automatic opening structure, the handle is an essential component. As a result, a refrigerator having this type of separating device has similar problems to those set forth above. Further, time is consumed as the structure senses when the user holds the handle and draws out the receiving box, thus degrading efficiency. That is, the reaction time of this type of receiving box separating device may not significantly improve user convenience. Additionally, since the receiving box separating device simply pushes the receiving box by a predetermined distance to separate the receiving box from the main body of the refrigerator, the user must still pull the handle after the initial separation to fully open the receiving box. When a weight of items received in the receiving box is heavy, it may be difficult to fully draw out the receiving box manually.

A motor that is fixed to a bottom surface of the freezing chamber has also been developed to draw the freezing chamber door and receiving box out using a driving force of the motor. More specifically, the motor may be fixed to the bottom surface of the freezing chamber and a rotation member, for example, a gear may be connected to a rotational shaft of the motor. The bottom surface of the receiving box contacts the rotational member, such that the receiving box moves forward and backward depending on the direction of rotation of the rotational member.

In a refrigerator having a driving motor and a gear assembly provided at the bottom surface of the refrigerating chamber or the freezing chamber, a storage volume of the refrigerator may be reduced accordingly. The driving motor and the gear assembly may be installed in a recess formed in an inner case of the refrigerator to compensate for the loss of storage volume. However, this may require removal of a heat shield layer typically mounted between the inner and outer case of the main body, or for the heat shield layer to be thinner, such that the heat shield effect between the inside of the refrigerator and the interior of a room is degraded.

Additionally, the motor and the gear assembly would typically engage a rack mounted along the bottom surface of the receiving box in a front to back direction, a maximum length of the rack corresponding to the entire length of the bottom surface of the receiving box. A machine room in which components such as a compressor and a condenser are received is typically provided at a rear lower portion of the refrigerator, causing the rear surface of the receiving box of the freezing chamber to be inclined in a bottom freezer type refrigerator. Thus, the entire length of a lower end of the receiving box of the freezing chamber is less than the entire length of an upper end of the receiving box of the freezing chamber. In this case, when the receiving box of the freezing chamber is drawn fully out, the rear portion of the upper end of the receiving box of the freezing chamber is not completely drawn out and not accessible.

Further, when a plurality of receiving boxes are vertically mounted in the refrigerator, a separate motor and gear assembly may be required for each receiving box, also requiring separate barriers at upper and lower sides of the receiving boxes.

Additionally, a refrigerator having such a motor structure may sense whether the receiving box is completely drawn out or completely closed using, for example, lead switches on the front end and rear end of the rack that is installed on the bottom surface of the refrigerator. However, the refrigerator cannot sense whether the receiving box is drawn in or out at a normal speed, whether the operation of drawing the receiving box in or our is hindered by an obstacle, or whether the receiving box is drawn in or out at a set speed, regardless of the weight of items received in the receiving box.

At times, when drawing out the receiving box, if the receiving box is moved to a movable maximum distance by a motor, a collision sound may occur in a slide assembly that moves the receiving box. This may lead to user concerns regarding durability. Further, if the slide rail repetitively collides with a stopper, components may be damaged or worn. Additionally, such a collision may cause the receiving box to move back by a predetermined distance due to the impact or the repulsive force caused by the collision between the slide rail and the stopper.

As shown in FIG. 1, a refrigerator 1 according to an embodiment as broadly described herein may include a main body 10 having a storage space formed therein. The storage space may include at least one of a refrigerating chamber 11 that stores items at an appropriate temperature and a freezing chamber 12 that freezes and stores items at an appropriate temperature. In this exemplary embodiment, the refrigerating chamber 11 is positioned at an upper side of the main body 10 and the freezing chamber 12 is positioned at a lower side of the main body 10. Other arrangements may also be appropriate.

The refrigerating chamber 11 may be selectively opened and closed by one or more refrigerating chamber doors 15 that may be rotatably coupled to the front surface of the main body 10, and that may include a handle 151 that may be grasped by a user.

The freezing chamber 12 may be selectively opened and closed by one or more freezing chamber doors 17 and 19. In the embodiment shown in FIG. 1, the freezing chamber 12 is partitioned into two spaces individually opened and closed by an upper door 17 that opens and closes an upper space of the freezing chamber 12 and a lower door 19 that opens and closes a lower space of the freezing chamber 12. The doors 17 and 19 and receiving boxes 175 and 195 respectively fixed thereto may be drawn into and out of the freezing chamber 12 in a drawer like fashion. Other arrangements, such as a single freezing chamber door, side by side freezing chamber doors, and the like, may also be appropriate based on user preferences.

The upper door 17 may be slidably drawn in and out to open and close the upper space of the freezing chamber 12. The receiving box 175 may be attached to a rear side of the upper door 17, and be attached to and detached from a slide assembly 30 (see FIG. 2) that moves the upper door 17 forward and backward. A rail connector 34 may be coupled to the slide assembly 30 and the receiving box 175 so as to be drawn in and out together with the upper door 17. A handle 171 may be provided on the front surface of the upper door 17 to be grasped by a user and move the upper door 17. The upper door 17 may be manually drawn in and out by a user grasping the handle 171 and pulling/pushing. Alternatively, the upper door 17 may be automatically drawn in and out in response to a user command received at an input unit.

The lower door 19 may be slidably moved in a manner similar to the upper door 17 so as to open and close the lower space of the freezing chamber 12. In this embodiment, the freezing chamber 12 is closed by two doors. However, in alternative embodiments, the freezing chamber 12 may be opened and closed by one door, or by more than two doors.

One of the refrigerating chamber doors 15 may be provided with a dispenser 20 including a dispensing unit 21 that dispenses water and/or ice and an operation unit 22. The operation unit 22 may include a display device 221 that displays the operation state of the dispenser 20 or the refrigerator 1 and a plurality of buttons that control operations of the dispenser 20, the refrigerator 1, and other components.

Simply for ease of discussion, hereinafter, the movement of the upper door 17 and receiving box 175 attached thereto will be described. However, it is well understood that the concepts set forth herein may be applied to other doors/receiving boxes provided in both the freezing chamber 12 and the refrigerating chamber 11.

The operation unit 22 may also include an input unit 222 that receives an input for sliding and drawing in and out the door 17/receiving box 175. The input unit 222 may be, for example, a capacitance switch that operates based on a change in capacitance, a tact switch, a toggle switch, or other type of switch as appropriate. For example, the input unit 222 may be a user voice recognizing device, a sound recognizing device, a light sensing device, a touch screen device, a keypad, or other such device.

The input unit 222 may be provided at the dispenser 20 or at the operation unit 22, or may be independently provided at the front surfaces or side surfaces of one the doors 15, 17, and 19. Other locations may also be appropriate.

For example, the input unit 222 may be provided at one side of the front surface of the particular door that is equipped to be automatically opened, and may be a vibration sensing switch that senses vibration transferred to the door. In other words, a weak impact may be to the door using, for example, the user's foot in a situation where the user's hands are both full. In this instance, the vibration sensing unit senses vibration transferred from the impact, and operates the door such that the door can be slidably drawn in and out.

In certain embodiments, the input unit 222 may be provided as a single button so that it may receive all drawing in and out commands of the door 17. Alternatively, a first button may be provided to receive the drawing out command, and a second button may be provided to receive the drawing in command. For example, in the case where the input unit 222 is provided as a single button, the input unit 222 may be configured so that if the button is pressed when the door 17 is drawn in, the pressing of the single button is determined to be a drawing out command. Similarly, if the button is pressed when the door 17 is drawn out, the pressing of the single button is determined to be a drawing in command. In this case, if the button is pressed as the door 17 is moving or the button is continuously pressed for a predetermined time, it may be determined to be a stop command. In other words, a particular user command may be determined based on the pressing frequency and pressing time of the single button provided as the input unit 222.

A machine room may be partitioned from the storage space to generate cool air supplied to the storage space, and may be provided at one side of the main body 10 to house the appropriate components. The machine room may house, for example a compressor that compresses refrigerant at high temperature and high pressure, a condenser that condenses the refrigerant supplied by the compressor, an expander that expands the refrigerant supplied by the condenser to lower the pressure. Refrigerant passing through the expander may be supplied to an evaporator that is provided at one side of the storage space so as to exchange heat with air circulating in the storage space.

Figure 2:
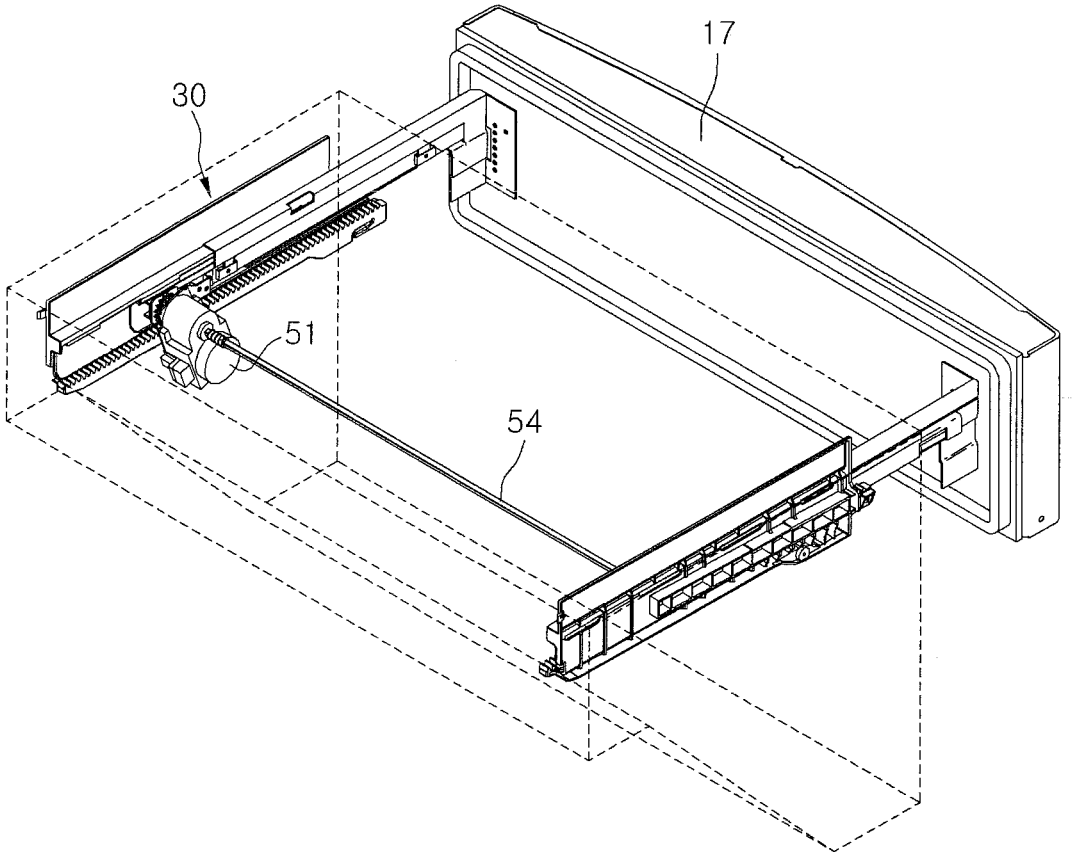
FIG. 2 is a rear perspective view of a door structure of the refrigerator shown in FIG. 1.
Figure 3:
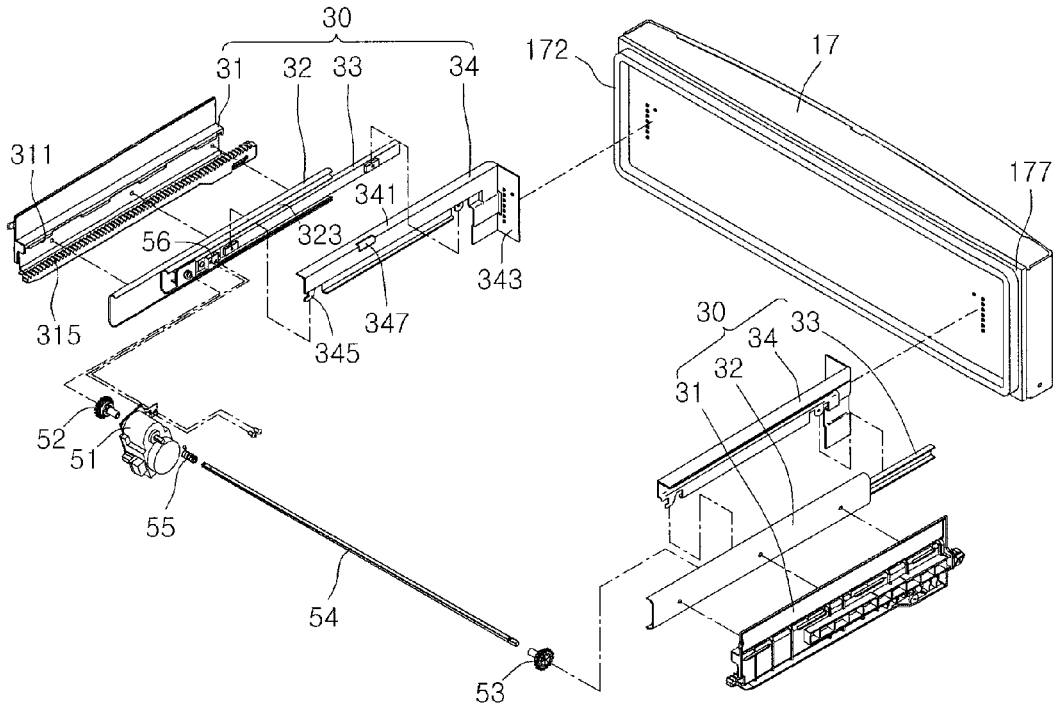
FIG. 3 is an exploded perspective view of the upper door shown in FIG. 2.
Figure 4:
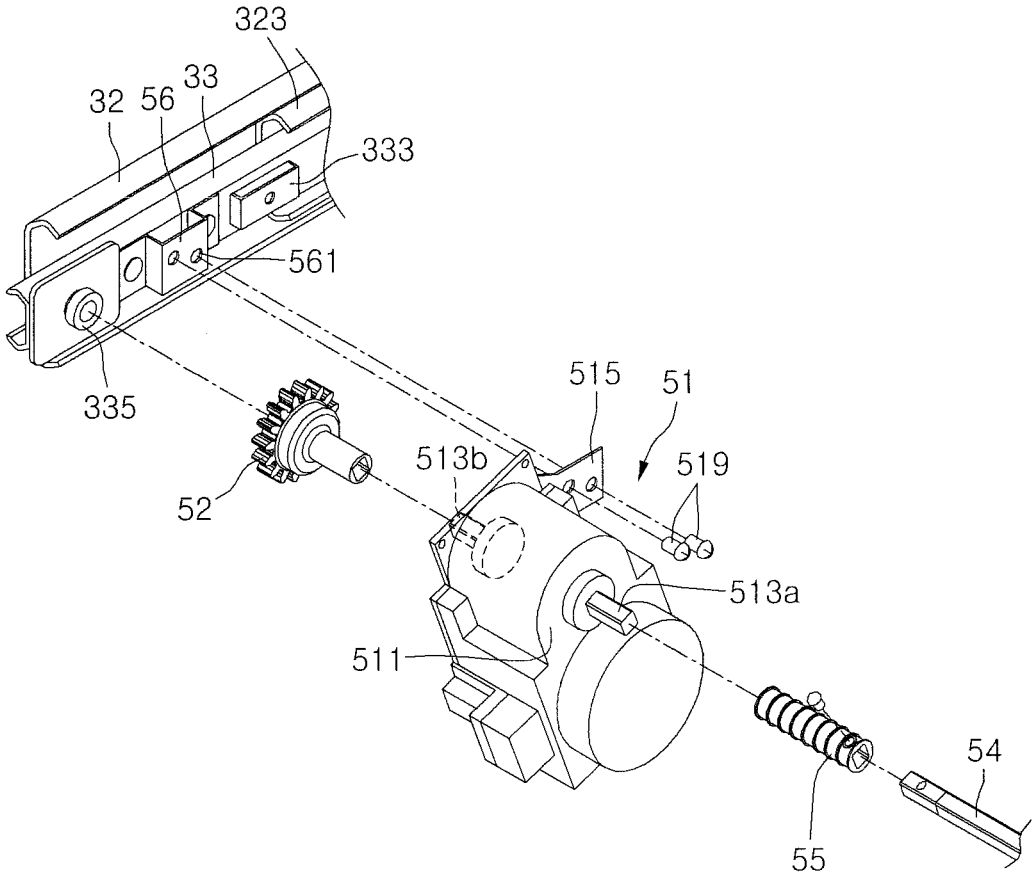
FIG. 4 is an exploded perspective view of a driving assembly coupled to a slide assembly as shown in FIGS. 2 and 3.

Referring to FIGS. 2 to 4, the door 17 may be configured to connect to a slide assembly 30 so as to open and close the corresponding upper portion of the freezing chamber 12. The slide assembly 30 may be fixed to a side wall of the freezing chamber 12, and include a rail connector 34 that is fixed to the door 17. The door 17 may move forward and backward according to the sliding movement of the slide assembly 30, and the receiving box 175 may be removably coupled to the slide assembly 30 or the rail connector 34. In the embodiment shown in FIGS. 2-4, the receiving box 175 is connected to the rail connector 34.

The slide assembly 30 may include a rail guide 31 that is fixed to the inner wall of the freezing chamber 12, a fixing rail 32 that is coupled to the rail guide 31, and a moving rail 33 that is slidably coupled to the fixing rail 32. The moving rail 33 is coupled to the rail connector 34 that is coupled to the rear surface of the door 17.

A rail guide 31 is provided at the two opposite side walls of the freezing chamber 12, respectively, and extends in a direction in which the door 17 is drawn in and out, in the front and rear direction of the refrigerator 1. The rail guide 31 may be firmly coupled to the inner side wall of the freezing chamber 12 by a bolt, or other fastener as appropriate so that the door 17 may be stably supported as it is drawn in and out.

A rack 315 that guides movement of a pinion 52 may be formed at a lower end of the rail guide 31. The rack 315 may protrude by a predetermined distance inward from the lower end of the rail guide 31 toward an interior of the freezing chamber 12 so as to receive the pinion 52 thereon. In addition, the rack 315 may be essentially straight so that the central portion of the pinion 52 may move straight along the rack 315, and the rack 315 may extend from the rear end of the freezing chamber 12 to the front end thereof. The upper end of the rail guide 31 may be somewhat curved toward the interior of the freezing chamber 12 so as to form a supporting part 311 that supports a seating part 341 of the rail connector 34.

The fixing rail 32 is positioned within and coupled to a space formed between the rack 315 and the supporting unit 311 of the rail guide 31. The fixing rail 32 may include a guide part 323 to guide the sliding movement of the moving rail 33. The guide part 323 may include an upper guide and a lower guide that protrude toward the interior of the freezing chamber 12 from upper and lower ends of the fixing rail 32, and that are spaced by a distance corresponding to a width of the moving rail 33. The upper and lower guides may be curved facing each other and may extend a predetermined length so as to retain the moving rail 33 therein during the sliding movement. In other words, the upper and lower guides may be shaped so as to hold the upper side and lower side of the moving rail 33, respectively. The guide part 323 may extend in parallel with the rack 315 so that the moving rail 33 is smoothly moved linearly. The fixing rail 32 may be firmly coupled to the guide rail 31 by a bolt, or other fastener as appropriate so that the door 17 may be stably supported as it is drawn in and out.

The moving rail 33 may be slidably connected to the fixing rail 32. The moving rail 33 may have an elongated plate shape that corresponds to the width of the guide part 323. The upper end and lower end of the moving rail 33 may be formed to correspond to the shape of the guide part 323 and may be seated in the guide part 323 so as to slide forward and backward. The moving rail 33 may include an inserting part, or receiver 333 in which a hooking ring 345 may be inserted. The receiver 333 may protrude a predetermined distance toward the interior of the freezing chamber 12 so as to form a groove into which the hooking ring 345 may be inserted.

The rear end of the moving rail 33 may include a bracket 56 on which a driving motor 51 may be fixedly mounted. The bracket 56 may be formed at a point that is spaced by a predetermined distance to the rear of the receiver 333. The bracket 56 may include a plurality of holes 561 that engage the driving motor 51. The bracket 56 may be fixedly mounted on the moving rail 33 by a rivet, a bolt, or other fastener as appropriate.

A pinion supporting part 335 to which the pinion 52 is coupled may be formed at one side of the bracket 56, and spaced apart by a predetermined distance from the bracket 56 so as to communicate with the driving motor 51. In certain embodiments, the pinion supporting unit 335 may be formed integrally with the bracket 56. In the embodiment shown in FIG. 4, the pinion supporting part 335 is provided to the rear of the bracket 56. The pinion supporting unit 335 may include grooves onto which the pinion 52 may be mounted and rotated.

In alternative embodiments, the fixing rail 32 may be slideable like the moving rail 33. In other words, the rail guide 31 may include a guide part in which the fixing rail 32 may be received, and the fixing rail 32 may be slidably coupled to the guide part so that the door 17 has a multi-stage movement structure.

The moving rail 33 may be coupled to the rail connector 34. The front end of the rail connector 34 may be fixed to the rear/interior surface of the door 17. In certain embodiments, a door liner 172 may protrude from an edge of the rear surface of the door 17, and the rail connector 34 may be coupled to the interior side of the door liner 172. Therefore, when the moving rail 33 slides, the door 17 also slides and the upper portion of the freezing chamber 12 may be selectively opened and closed. The upper end of the rail connector 34 may be curved toward the interior of the freezing chamber 12 to form a seating part 341 that seats the supporting part 311 so that the weight of items stored in the receiving box 175 is dispersed, making it possible to more stably operate the slide assembly 30.

The hooking ring 345 may be provided at the lower end of the rail connector 34, at a position corresponding to the receiver 333, and may have a hook shape so as to be inserted into the groove formed by the receiver 333. An opposite side of the lower end of the rail connector 34 may be coupled to the moving rail 33 by a bolt or other fastener as appropriate. Therefore, the rail connector 34 and the moving rail 33 may be decoupled and both the door 17 and the rail connector 34 may be separated from the refrigerator 1 by simply releasing the hooking ring 345 from the receiver 333.

The seating part 341 may include a receiving box fixing groove 347 that removably engages the receiving box 175. The receiving box 175 may be directly inserted into the receiving box fixing groove 347, or may be inserted in the fixing groove 347 through separate fixing member.

A gasket 177 may surround the outer periphery of the door liner 172. The gasket 177 may be adhered to a corresponding front face of the main body 10 so as to block communication between the inside and outside of the freezing chamber 12 when the door 17 is closed and form a seal therebetween. The gasket 177 may be formed of soft materials such as, for example, silicon, rubber, and the like to also absorb impact when the door 17 is closed.

The structure of the slide assembly 30 discussed above may be applied to both lateral sides of the freezing chamber 12 so that the door 17 may be smoothly drawn in and out. In certain embodiments, the bracket 56 may be provided with only one of the two moving rails 33 at one side of the freezing chamber 12, and the driving motor 51 may be coupled to only one of the slide assemblies 30.

The driving motor 51 may be coupled to the bracket 56 and move together with the moving rail 33 forward and backward. The driving motor 51 may be surrounded by a motor housing 511, and a first rotational shaft 513*a* and a second rotational shaft 513*b* may protrude from opposite sides of the housing 511. The first rotational shaft 513*a* may be connected to a connection part 55, and the second rotational shaft 513*b* may be connected to the pinion 52. In certain embodiments, the rotational shafts 513*a* and 513*b* may be positioned along substantially the same line so that the rotational shafts 513*a* and 513*b* rotate together at the same time as the driving motor 51 operates. The rotational shafts 513*a* and 513*b* may be formed as a single shaft.

The driving motor 51 may be, for example, a three phase blushless DC (BL DC) motor, a single phase induction motor, or other driving source as appropriate. The driving motor 51 may include a plurality of hall sensors to sense the rotation of the driving motor 51. For example, a three phase blushless DC (BLDC) motor functions as the driving motor 51, three hall sensors may be provided, and two hall sensors may be provided with a single phase induction motor. The driving motor 51 may be controlled by a controller 500 so that the rotation speed of the driving motor 51 is variable.

In certain embodiments, a motor whose rotational shafts 513*a* and 513*b* may be rotated by an external force, even when power is not supplied to the motor, may function as the driving motor 51 so that the user can either automatically draw the door 17 in and out by applying power to the driving motor 51, or manually draw the door 17 in and out using the handle 171, without applying power to the driving motor 51.

The motor housing 511 may include a flange 515 that fixes the driving motor 51 to the moving rail 33, and in particular, to the bracket 56. The flange 515 may include a plurality of holes that receives appropriate fasteners that extend into the holes 561 in the bracket 56. Further, the flange 515 may be formed so that the pinion 52 inserted onto the second rotational shaft 513*b* may be connected to the pinion supporting part 335. In other words, the flange 515 may extend a predetermined length from the housing 511 so that when it is fixed to the bracket 56, the center of the pinion 52 may be rotatably connected to the pinion supporting part 335. Therefore, when the driving motor 51 is coupled to the bracket 56, the center of the pinion supporting part 335, the center of the pinion 52, and the first rotational shaft 513*a* are all disposed on the same axis. In certain embodiments, the driving motor 51 is fixed to the moving rail 33 by the coupling of the flange 515 and the bracket 56, and the pinion supporting part 335 may be unnecessary.

The pinion 52 may be sized so that when it is inserted onto the pinion supporting part 335 its outer circumference engages with the rack 315 so that the pinion 52 moves along the rack 315. As the pinion 52 transfers the rotational force from the driving motor 51, the pinion 52 may be referred to as a rotational force transferring member. As the rack 315 guides the movement of the rotational force transferring member, the rack 315 may be referred to as a guide member.

The first rotational shaft 513*a* may be connected to a shaft 54 through the connection part 55. A first of the connection part 55 may include grooves corresponding to the shape of the first rotational shaft 513*a*, and a second end opposite the first end thereof may include grooves corresponding to the shape of the shaft 54. The first end of the connection part 55 is coupled to the first rotational shaft 513*a* and second end thereof is coupled to the shaft 54, so that the rotation of the rotational shaft 513*a* is transferred to the shaft 54. The shaft 54 may be fixed to the connection part 55 by a bolt, or other fastener as appropriate.

The shaft 54 extends across the freezing chamber 12 in a transverse direction, with a first end thereof connected to the connection part 55 and a second end thereof directly connected to a second pinion 53. This second pinion 53 is connected to the pinion supporting part 335 of the second slide assembly 30 provided at the second side wall of the freezing chamber 12, opposite the first slide assembly 30 provided at the first sidewall discussed above, such that it can be rotated. Therefore, when the rotational shafts 513 and 513*b* are rotated by the driving motor 51, such the pinions 52 and 53 on both sides are rotated at the same rotational speed.

The driving motor 51, the shaft 54, and the pinions 52 and 53 form a driving unit that slidably moves the slide assembly 30 and the door 17 and may be referred to a door driving assembly. In certain embodiments, the door driving assembly includes at least the driving motor 51 and the first pinion 52.

The driving motor 51 may be provided at the rear end of the moving rail 33. In order to prevent interference at the rear wall surface of the freezing chamber 12 when the door 17 is completely closed, the driving motor 51 may be formed or positioned at an incline to correspond to the shape of the rear wall of the freezing chamber 12.

Operation of the refrigerator 1 according to an embodiment as broadly described herein will now be discussed.

If the user inputs a drawing in or out command of the door 17 through the input unit 222, power is applied to the driving motor 51 to rotate the rotational shafts 513*a* and 513*b*.

In particular, if the drawing out command is input at the input unit 222, power is applied to the driving motor 51 so that the rotational shafts 513*a* and 513*b* rotate forward (the clockwise direction shown in FIG. 3). As a result, the pinions 52 and 53 also rotate clockwise and move forward along their respective racks 315, causing the respective moving rails 33 to also move forward. The moving rails 33 are guided by the guide parts 323, and the rail connectors 34 are fixed to the moving rails 33 such that receiving box 175 and the door 17 move together to provide access to the receiving box 175 for the insertion and/or removal of storage items.

If the drawing in command is input at the input unit 222, power is applied to the driving motor 51 so that the rotational shafts 513*a* and 513*b* rotate in a reverse direction (the counter-clockwise direction in FIG. 2). As a result, the pinions 52 and 53 also rotate counter-clockwise and move backward along their respective racks 315, causing the respective moving rails 33 to move backward and the door 17 to close the upper portion of the freezing chamber 12.

In a refrigerator 1 as embodied and broadly described herein, the receiving box 175 is automatically drawn in and out together with the upper door 17 by operating only the input unit 222 that receives the door drawing in and out commands input by the user, thus improving user convenience.

In addition, since the receiving box 175 is automatically drawn out, the receiving box 175 may be conveniently drawn out regardless of the weight of items received in the receiving box 175.

In addition, the driving motor 51 is not fixed to the main body 10, but instead movably provided together with the receiving box 175, so that the volume of the inside of the refrigerator 1 is not reduced by the volume of the motor 51.

In addition, the driving motor 51 is not fixed to the main body 10, but is instead movably provided together with the receiving box 175, so that a reduction in the heat shield effect due to a reduction in the heat shield layer of the main body 10 is not experienced.

Moreover, when the driving motor 51 is movably provided together with the receiving box 175, making it possible to sufficiently use the space between adjacent receiving boxes may be used efficiently.

Further, the driving motor 51 is not directly connected to the rail connector 34 which is directly connected to the upper door 17, but is instead indirectly connected through the moving rail 33, making it possible to conveniently attach and detach the upper door 17 if necessary.

Further, the guide that guides the movement of the receiving box 175 is not subjected to the restriction of the machine room and thus may be formed sufficiently long in the front and rear direction of the main body so that the upper door 17 and the receiving box 175 may be fully drawn out, providing full access to the inner space of the receiving box 175.

Figure 5:
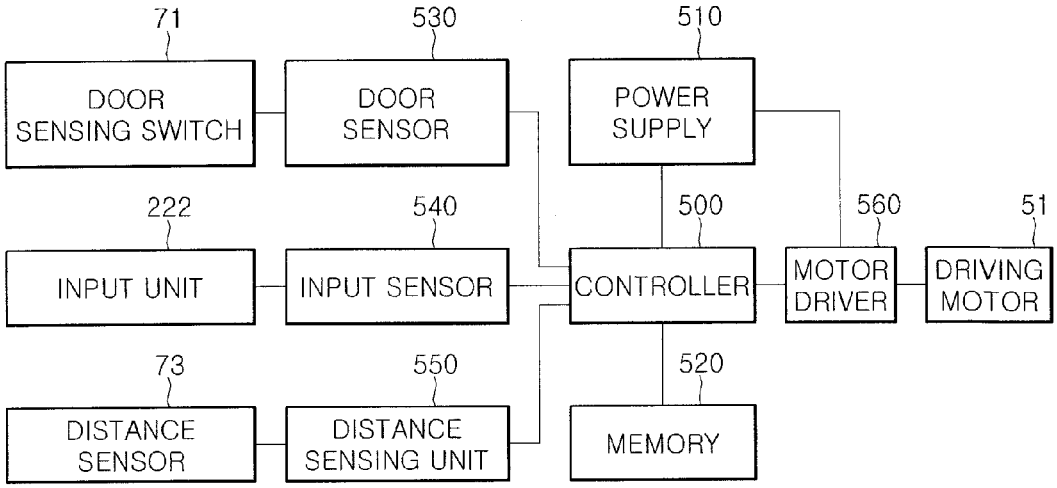
FIG. 5 is a block diagram of control components of a refrigerator according to an embodiment as broadly described herein.

Hereinafter, a method for controlling the refrigerator 1 having the above configuration will be described with respect to FIGS. 5 and 6. As shown in FIG. 5, the refrigerator 1 may include the controller 500 that controls a power supply 510 that supplies power each component of the refrigerator 1, a memory 520 that stores information related to operation of the refrigerator 1, a door sensor 530 that senses whether the door 17 is opened or closed, an input sensor 540 that senses that a command has been received by input unit 222, a distance sensing unit 550 that senses a distance from the door 17, and a motor driver 560 that controls the operation of the driving motor 51 such as, for example, by controlling a voltage, applied to the driving motor 51.

The power supply 510 may also be connected to the motor driver 560 to supply power to the driving motor 51. In this case, the motor driver 560 may switch (for example, switching a DC voltage into an AC voltage) a waveform of power supplied from the power supply 510 and may supply it to the driving motor 51. In addition, the motor driver 560 may include a processor that controls the driving motor 51, any hall sensors, and the like.

A door sensing switch 71 that senses whether the door 17 is opened or closed may be provided at one side of the main body 10. The door sensing switch 71 may include, for example, a pressing switch, such that when the door 17 is closed, the pressing switch is pressed and when the door 17 is opened, it is not pressed and extends outward. A signal generated by the door sensing switch 71 may be transmitted to the controller 500 through the door sensor 530.

The input sensor 540 is connected to the input unit 222 and transmits an input/received command to the controller 500. For example, when the input unit 222 is provided as a single button, the input sensor 540 transmits a signal informing the controller 500 that the single button has been pressed. The controller 500 may then determine that the desired action is the opening or closing of the door 17 according to whether the door 17 is currently opened or closed.

The distance sensing unit 550 may be connected to a distance sensor 73. The distance sensor 73 may sense a distance the door 17 or the receiving box 175 has moved. The distance sensor 73 may be a sensor using, for example, infrared rays or ultrasonic waves, or other distance measuring devices as appropriate. The distance sensor 73 may be mounted on, for example, the rear wall surface of the freezing chamber 12 to sense a distance between the rear surface of the receiving box 175 and the rear wall surface of the freezing chamber 12, or may be mounted on the front surface of the main body 10 to measure the distance between the main body 10 and the door 17. Other arrangements may also be appropriate.

In alternative embodiments, the motor driver 560 may calculate a number of rotations of the driving motor 51 based on a signal generated the hall sensor included in the driving motor 51 and estimate the distance the door 17 and the receiving box 175 has moved based on the number of rotations. The distance the moving rail 33 has moved may be calculated by multiplying $\pi$ by a diameter of the pinion 52 and then multiplying the product by the number of rotations of the driving motor 51. This will correspond to the distance the door 17 has moved. In this case, the hall sensor of the driving motor 51 may function as the distance sensor 73 and the motor driver 560 may function as the distance sensing unit 550.

The motor driver 560 receives a control signal from the controller 500 to drive the driving motor 51. The motor driver 560 may also apply power supplied from the power supply 510 to the driving motor 51 under the control of the controller 500. The memory 520 may store various set values necessary for driving the driving motor 51 in the controller 500.

Figure 6:
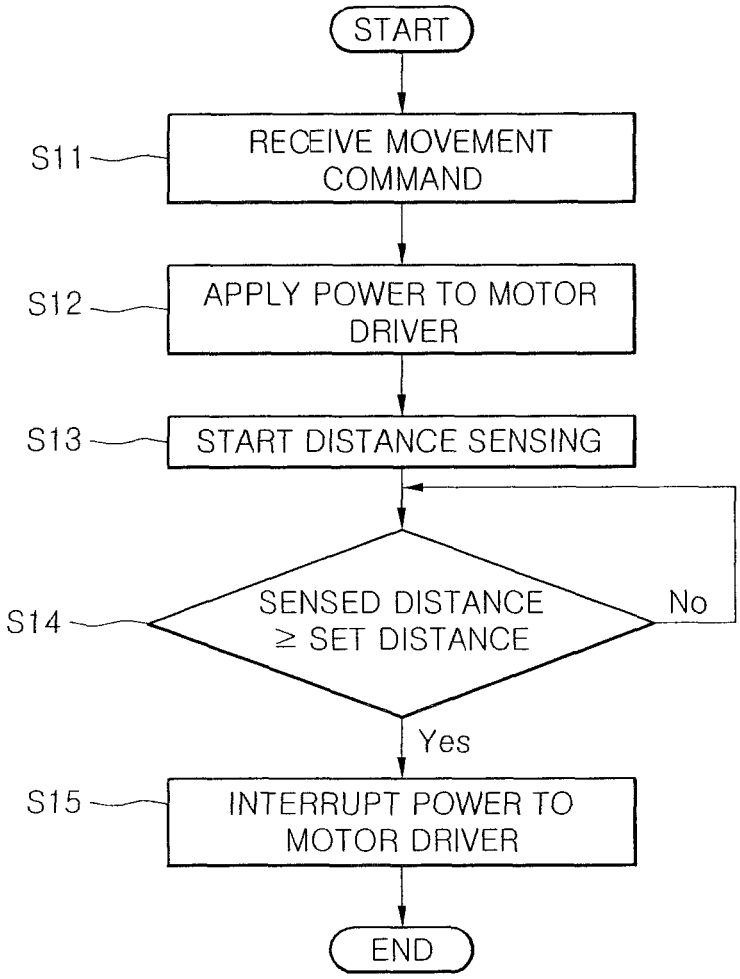
FIG. 6 is a flowchart of a method of controlling a refrigerator according to an embodiment as broadly described herein.

FIG. 6 is a graph in which a voltage applied to a motor driver is changed based on distance that door 17 has been drawn out, in accordance with a method as embodied and broadly described herein.

Figure 7:
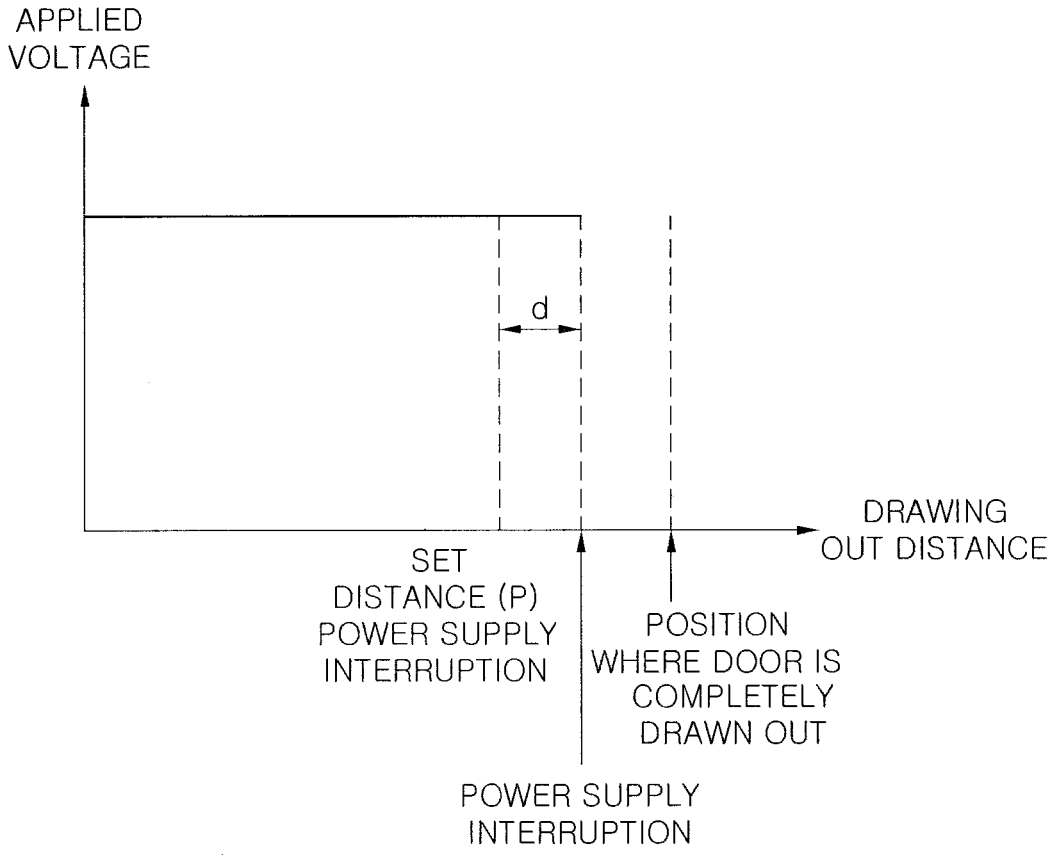
FIG. 7 is a graph of voltage applied to a motor driver as a door and associated drawer structure are drawn out of a refrigerator by the method shown in FIG. 6.

Referring to FIG. 7, the input sensor 540 senses a command to move the door 17/receiving box 175 has been input at and received by the input unit 222 (S11). Simply for ease of discussion, the movement command will be assumed to be a drawing out command.

When the input unit 222 is formed as a single button and the drawing out command and the drawing in command are input by actuating this single button, actuation of the single button may be determined to be the drawing in command when the door 17 is opened (the drawn out case), and may be determined to be the drawing out command when the door 17 is closed (the drawn in case). The door sensing switch 71 or the distance sensor 73 may be used to determine whether the door 17 is opened or closed.

When the drawing out command of the door 17 is input, the input sensor 540 transmits a signal to the controller 500 and the controller 500 applies a predetermined power to the motor driver (S12). The applied voltage may be assumed to be V1. The door 17 moves at a predetermined speed based on the size of voltage applied to the motor driver 560.

The distance sensing unit 550 starts to sense the distance from the door 17 (S13). The distance sensing unit 550 may continuously sense the distance from the door 17, and distance value sensed in the distance sensing unit 550 may be continuously transmitted to the controller 500. In a situation in which the door 17 is being drawn out, the distance value from the door 17 sensed by the distance sensing unit 550 will increase.

The controller 500 compares the sensed distance transmitted by the distance sensing unit 550 with a set distance P (S14). The set distance P may be previously stored in the memory 520. The detailed contents related to the set distance P will be described below.

If the sensed distance is greater than or equal to the set distance P, the controller 500 interrupts power supplied to the motor driver 560 (S15) so that the force applied to the door 17 is removed. The door 17 was moving at a predetermined speed based on the applied voltage V1 before the power supply was interrupted. However, even after the power supply is interrupted, the door 17 continues to move in the current direction due to inertia. The door 17 consequently stops due to the friction between the pinions 51 and 52 and the respective racks 315. In other words, even though the power supplied to the motor driver 560 is interrupted, the door 17 continues to move further by a predetermined distance in the current direction due to inertia. The distance that the door 17 moves due to inertia is assumed to be an inertia moving distance d. The inertia moving distance d may be proportional to the weight of the door 17 and the receiving box 175.

The heavier the weight of items stored in the receiving box 175, the larger the inertia moving distance d may be. Therefore, when manufacturing the refrigerator 1, the inertia moving distance d may be stored in the memory 520 according to a maximum allowable combined weight of the door 17, the receiving box 175, and items stored therein.

In certain embodiments, it may be possible to apply the inertia moving distance d by experimentally measuring the inertia moving distance d according to the weight of items stored in the receiving box 175, storing the measured inertia moving distance din the memory 520, and measuring the weight of the receiving box 175 when inputting the drawing out command.

The set distance P may be determined by subtracting the inertia moving distance d from a maximum drawing out position Dmax of the door 17. The maximum drawing out position Dmax corresponds to the moving distance from a state where the door 17 is completely drawn in to a state in which the door 17 is completely drawn out. The state where the door 17 is completely drawn out may refer to a state in which the moving rail 33 or the rail connector 34 moves forward and is hooked into a stopper mounted on the fixing rail 32 or the rail guide 31 so that it cannot move forward any further.

When the door 17 is positioned at the set distance P, the supply of power is interrupted (S15), such that the door 17 is further drawn out by the inertia moving distance d and then stops. Since the set distance P may be less than a value determined by subtracting the inertia moving distance d from the maximum drawing out distance Dmax, the stopping position of the door 17, the door 17 may not necessarily be completely opened. In other words, after the power applied to the driving motor 51 is interrupted, a power interrupting point is determined so that a point at which the door 17 moves due to inertia and then stops due to friction force may be a point before the maximum drawing out position Dmax is reached.

In other words, when being automatically drawn out, the upper door 17 stops at a point at which it is not completely drawn out and a remainder of the movement is carried out due to inertia and then stopped due to friction. Even if the upper door 17 is not completely drawn out, the difference between the actual drawn out distance and the maximum distance Dmax may be negligible, and may be controlled to within a few cm.

In a method as embodied and broadly described herein, the door 17 stops at a position where it is not completely drawn out, such that the moving rail 33 or the rail connector 34 does not collide with the stopper, thus avoiding a collision sound between the door 17 and the stopper. In addition, the lifespan of the slide assembly 30 may be increased by preventing the collision or impact occurring within the slide assembly 30.

Moreover, the door 17 moves by inertia and then naturally stops, such that retreat of the door 17 due to the impact or the repulsive force when automatically drawing out the door 17 may be prevented.

Additional information regarding the structure and function of a drawer type refrigerator may be found in U.S. application Ser. Nos. 12/390,520, 12/390,523, 12/390,524, 12/390,527 and 12/510,372, which are incorporated herein by reference.

A refrigerator is provided that is capable of automatically drawing out the receiving box depending on the selection of a user and a method for controlling the same.

A refrigerator is provided that is capable of securing the volume of the inside of the refrigerator and preventing the degradation of heat shield performance while providing a function of automatically drawing in and out a receiving box and a method for controlling the same.

A refrigerator is provided that is capable securing a volume of the inside of the refrigerator even when a plurality of automatically drawing in and out receiving boxes are continuously formed and a method for controlling the same.

A refrigerator is provided that is capable of easily attaching and detaching a drawn in and out door together with a receiving box to the refrigerator and a method for controlling the same.

A refrigerator is provided that is capable of automatically drawing in and out a receiving box and then conveniently receiving foods in an inner space of the receiving box and a method for controlling the same.

A refrigerator is provided that is capable of preventing a collision sound from occurring when drawing out the receiving box and a method for controlling the same.

A refrigerator is provided that is capable of increasing a lifespan of a slide assembly in a receiving box and a method for controlling the same.

A refrigerator is provided that is capable of preventing a receiving box from automatically retreating when drawing out the receiving box and a method for controlling the same.

A refrigerator according to an embodiment as broadly described herein may include a main body that has a storage space storing foods at low temperature; a door that straightly moves to selectively open and close the storage space; a receiving box that is mounted on a rear of the door and straightly moves together with the door; a slide assembly that is mounted on a side wall of the storage space and straightly moves the door; a driving motor that is mounted on the slide assembly and provides a driving force for moving the door; and a controller that interrupts power applied to the driving motor at any position before the door is completely drawn out.

A method for controlling a refrigerator according to an embodiment as broadly described herein may include transmitting a drawing out order of a door to a controller; applying power to a driving motor that provides a movement force of the door; sensing the position of the door; and interrupting power applied to the driving motor at any point before the door is completely drawn out.

In a refrigerator and method for controlling a refrigerator according to embodiments as broadly described herein, the receiving box may be automatically drawn in and out together with the door only in response to a user input at an input unit, thereby increasing user convenience.

In addition, since the receiving box is automatically drawn out, the receiving box may be conveniently drawn out regardless of the weight of items received in the receiving box.

Further, since the driving motor for automatically drawing out the receiving box is not fixedly mounted to the main body of the refrigerator and may be moved together with the receiving box, the volume of the inside of the refrigerator is not adversely affected.

Also, since the driving motor is not fixedly mounted to the main body and can be moved together with the receiving box, the heat shield effect may be reduced due to the reduction in the thickness of the heat shield layer of the main body.

Also, the driving motor may be movably provided together with the receiving box, making it possible to efficiently use the space between adjacent receiving boxes.

Moreover, the driving motor is not directly connected to the components that are connected to the door, making it possible to conveniently attach and detach the door if necessary.

Further, a guide that guides movement of the receiving box may be sufficiently long in a front to rear direction of the main body to substantially fully draw out the door and the receiving box, making it possible to conveniently store and access items in the inner space of the receiving box.

Further, power applied to the driving motor may be interrupted before the door is completely opened, such that the door moves the distance due to inertia, thereby making it possible to prevent the colliding sound caused by the collision of the slide rail of the door and the stopper. In addition, the slide rail does not collide with the stopper, thereby increasing the lifespan of the slide assembly and preventing the door from retreating due to the impact or the repulsive force.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a storage space formed therein;

a door movably coupled to the storage space, wherein the door moves linearly with respect to the main body so as to selectively open and close the storage space such that the door has a fully closed position in which the door is positioned against the main body so as to close the storage space and a fully open position in which the door is at a maximum distance from the main body so as to fully open the storage space;

a receiving box coupled to a rear surface of the door so as to move linearly together with the door;

a first sliding assembly, comprising:

a first rail guide fixed to a first inner wall of the storage space, the first rail guide including a rack;

a first fixing rail coupled to the rail guide; and a first moving rail slidably coupled to the first fixing rail and fixedly coupled to the door, the first moving rail including a bracket;

a second sliding assembly, comprising:

a second rail guide fixed to a second inner wall of the storage space, the second rail guide including a second rack;

a second fixing rail coupled to the second rail guide; and a second moving rail slidably coupled to the second fixing rail and fixedly coupled to the door;

a motor mounted on the bracket of the first moving rail;

a first pinion provided on a first rotational shaft of the motor and engaged with the first rack;

a connecting shaft having a first end connected to a second rotational shaft of the motor;

a second pinion connected to a second end of the connecting shaft and engaged with the second rack, wherein the motor provides a driving force that moves the door and the receiving box coupled thereto, and wherein the motor is coupled to the door such that the motor moves together with the door when the motor operates; and a controller that selectively applies power to the motor, wherein, in response to a door opening command, the controller is configured to supply power to the motor, and to then interrupt power to the motor at a set position that is prior to the door reaching the fully open position.

2. The refrigerator of claim 1, further comprising:

a distance sensor that measures a distance to the receiving box or to the door, wherein, in the set position, a distance D1 between the distance sensor and the door is less than a distance D2 at which a speed of the door is reduced by friction force subtracted from a distance D3 at the fully open position of the door ($D1<D3-D2$).

3. The refrigerator of claim 1, wherein, after power is interrupted at the set position, the door continues to move past the set position to an inertia position and then stops at the inertia position due to friction force, wherein the inertia position of the door is reached prior to the fully open position.

4. The refrigerator of claim 1, wherein the first moving rail comprises a pinion supporting part to which the first pinion is coupled.

5. The refrigerator of claim 1, further comprising a rail connector that couples the first moving rail to the door.

6. The refrigerator of claim 1, further comprising a connector that connects the shaft to the second rotational shaft of the motor.

* * * * *